US008887753B2

(12) United States Patent
Sutherland

(10) Patent No.: US 8,887,753 B2
(45) Date of Patent: Nov. 18, 2014

(54) IN-LINE WATER TRAP

(75) Inventor: Dion Grant Sutherland, Gauteng (ZA)

(73) Assignee: Amphicom Investments CC, Gauteng (ZA)

( * ) Notice: Subject to any disclaimer, the term of this patent is extended or adjusted under 35 U.S.C. 154(b) by 0 days.

(21) Appl. No.: 13/978,290

(22) PCT Filed: Jan. 4, 2012

(86) PCT No.: PCT/IB2012/050032

§ 371 (c)(1),
(2), (4) Date: Jul. 3, 2013

(87) PCT Pub. No.: WO2012/093357

PCT Pub. Date: Jul. 12, 2012

(65) Prior Publication Data

US 2013/0284282 A1 Oct. 31, 2013

(30) Foreign Application Priority Data

Jan. 5, 2011 (ZA) ..... 2011/00126

(51) Int. Cl.
*E03C 1/28* (2006.01)
*E03C 1/122* (2006.01)

(52) U.S. Cl.
CPC ..... *E03C 1/28* (2013.01); *E03C 1/1222* (2013.01)
USPC ..... 137/247.15; 137/247.35; 137/247.39; 4/679

(58) Field of Classification Search
USPC ..... 137/247.11, 247.13, 247.15, 247.29, 137/247.35, 247.39, 496, 517; 4/679
See application file for complete search history.

(56) References Cited

U.S. PATENT DOCUMENTS 270,473 A * 1/1883 Peitsch ..... 137/247.19
301,151 A * 7/1884 Peitsch ..... 137/247.19

(Continued)

FOREIGN PATENT DOCUMENTS

CN 2605314 Y 3/2004
EP 0654641 A2 5/1995

(Continued)

OTHER PUBLICATIONS

Translated abstract of EP 0654641 to Orehounig, May 24, 1995.

(Continued)

*Primary Examiner* — John Rivell
*Assistant Examiner* — Minh Le
(74) *Attorney, Agent, or Firm* — The H.T. Than Law Group

(57) ABSTRACT

An in-line water trap located in the line of the flow of waste through a generally straight line or bend is provided for. Typically, the water trap comprises a fluid conduit having a first end, a second end and a passage between the first and second ends; and a vessel having a closed end, an open end and a skirt between the closed and open ends, the lobed vessel further having an inner surface defining an inner volume and an outer surface, the inner surface attachingly engaging an outer wall of the fluid conduit in so doing defining a flow path between the passage, the inner volume of the lobed vessel and the outer surface of the lobed vessel, in use, a fluid level inside the inner volume of the lobed vessel being substantially in communication with the second end of the fluid conduit to form a fluid seal.

10 Claims, 10 Drawing Sheets

(56) References Cited

U.S. PATENT DOCUMENTS

| | | | | | |
|---|---|---|---|---|---|
| 303,640 | A | * | 8/1884 | Holland, Jr. | 137/247.29 |
| 460,557 | A | * | 10/1891 | Carroll | 137/247.39 |
| 491,330 | A | * | 2/1893 | Beaumont | 137/216.1 |
| 496,994 | A | * | 5/1893 | Brogan | 137/247.15 |
| 543,617 | A | * | 7/1895 | Dunstan | 210/247 |
| 578,024 | A | * | 3/1897 | Perkes | 137/247.39 |
| 635,383 | A | * | 10/1899 | Hamilton | 137/216.1 |
| 867,112 | A | * | 9/1907 | Connor | 119/264 |
| 904,286 | A | | 11/1908 | Waibel | |
| 1,175,836 | A | * | 3/1916 | Stubble | 137/247.39 |
| 1,507,531 | A | * | 9/1924 | Vaudell | 137/247.33 |
| 2,917,070 | A | * | 12/1959 | Langdon | 137/247.15 |
| 3,516,541 | A | * | 6/1970 | Hardingham | 210/164 |
| 3,725,964 | A | * | 4/1973 | Whitsett | 4/679 |
| 4,045,346 | A | * | 8/1977 | Swaskey | 210/164 |
| 4,051,859 | A | * | 10/1977 | Hoffman | 137/154 |
| 4,141,379 | A | * | 2/1979 | Manske | 137/496 |
| 4,182,355 | A | * | 1/1980 | Briel et al. | 137/496 |
| 4,212,314 | A | * | 7/1980 | Ericson | 137/216.2 |
| 4,254,512 | A | * | 3/1981 | Soderstrom | 4/679 |
| 4,681,131 | A | * | 7/1987 | Uriarte | 137/247.35 |
| 5,028,320 | A | * | 7/1991 | Gaudin et al. | 210/164 |
| 5,711,037 | A | * | 1/1998 | Reichardt et al. | 4/301 |
| 6,319,397 | B1 | * | 11/2001 | Su et al. | 210/163 |
| 6,662,387 | B2 | * | 12/2003 | Winzar | 4/679 |
| 6,701,541 | B2 | * | 3/2004 | Romagna et al. | 4/301 |
| 8,646,117 | B2 | * | 2/2014 | Avetisian | 4/144.1 |
| 2004/0134535 | A1 | * | 7/2004 | Mitchell | 137/247.35 |
| 2007/0277880 | A1 | * | 12/2007 | Vilendre et al. | 137/247.25 |
| 2009/0307837 | A1 | * | 12/2009 | Gan | 4/679 |

FOREIGN PATENT DOCUMENTS

| | | | |
|---|---|---|---|
| GB | 494578 | A | 10/1938 |
| JP | 2002242254 | A | 8/2002 |

OTHER PUBLICATIONS

Translated Abstract of JP 2002242254 A to Kimoto Kazuya, Aug. 28, 2002.

Translated Abstract of Translated Abstract of CN2605314 (Y)—Mar. 3, 2004 to Liu Yuqing.

International Search Report of corresponding International Application No. PCT/IB2012/050032, issued on Apr. 26, 2012.

* cited by examiner

IN-LINE WATER TRAP

FIELD OF THE INVENTION

This invention relates to water traps, particularly water traps used in plumbing applications, more particularly to water traps in plumbing applications associated with soil and/or waste water pipe drainage systems, even more particularly to an in-line water trap located in the line of the flow of waste water through a generally straight line or bend.

BACKGROUND OF THE INVENTION

Water traps are used in plumbing applications to prevent airborne diseases, insects and vermin and/or unwelcome odorous gases emanating from a drain stack or gully to re-enter a building causing health risks. The particular configuration of the water trap causes it to retain or trap a nominal amount of waste water after each occasion the plumbing application has been used, essentially creating a water seal and in so doing preventing the ingress of the aforesaid from a sewerage drainage system into a building.

Typically, water traps in plumbing applications comprise bottle traps or U, S or P shaped traps and are utilized in plumbing applications, such as toilets, sinks, wash-hand basins, bathtubs, showers and urinals. The various plumbing applications are in operative communication with a sewerage drainage system which facilitates the removal of waste in the form of soil and/or grey water (which can include rain water) from a building to a sewerage line of a greater reticulation system leading to a septic tank or a public sewer.

An important aspect to consider when designing water traps is the continued maintenance of the water seal. Depending on the size and configuration of a particular design a water trap can siphon off water resulting in its defective operation. Various measures are known to prevent water traps from siphoning off. These classically include providing a particular shape to the water trap and/or air by-pass, or employing purge valves in attendance to the trap and other air admittance valves and/or providing for venting within drain lines of the reticulation system.

The greater reticulation system is typically kept at a pressure close to or at atmospheric pressure. The flow of waste within the drainage system creates a positive pressure downstream of the flow which needs to be purged to prevent the water seal in the water traps downstream from being pushed back up into the plumbing application and allowing waste to enter the plumbing application from the drainage system, which is mostly undesirable, save for a gully which is placed to receive waste in that manner and in turn prevent same from occurring in those plumbing applications in which it is undesirable. The entering of waste into plumbing applications from the drainage system will result in unhygienic conditions with potentially severe health and safety implications. Upstream of the flow a negative pressure is created which needs to be purged to prevent upstream water traps from being siphoned off. In the event of the water seals being broken, airborne diseases and unwelcome odorous gases will freely be able to pass from within the drainage system into a plumbing application and into the building causing unhealthy and unsavory habitation conditions.

Venting and/or air by-pass pipes known to be used in helping to maintain desired pressure in the drainage system are costly, have been known to draw out water seals by high-velocity winds passing over the top of the stack and become clogged and thus prevent the effective purging of that system resulting in defective drainage of waste. Air admittance valves are also known to be used within drainage systems in order to maintain the desired pressure within that system. Although this venting means assists in the maintenance of a desired operative pressure within the drainage system, such mechanisms provide for additional movable parts in an apparatus assembly which often fail, and may be prone to maintenance and repair procedures escalating cost implications.

Typical existing water traps are prone to blockage owing to retained waste solids obstructing a necessary flow path having several bends and a relatively long confined flow path. There is consequently a need for a water trap design which will assist in the flow of waste or prevent the back flow of waste and which will assist in preventing the water seal being siphoned off under excess negative flow pressure. There is also a need for a water trap wherein the confined flow path is reduced having fewer confined bends facilitating the flushing of waste solids. There is a further need for easier and more convenient access to the water trap, if maintenance is required. Conventional drains also require separate access to the trap for maintenance to be conducted.

SUMMARY OF THE INVENTION

According to the invention there is provided an in-line water trap comprising:

- a fluid conduit having a first end, a second end and a passage between the first and second ends; and
- a lobed vessel for receiving the conduit having a closed end, an open end and a skirt between the closed and open ends, an inner surface of the closed end, open end and skirt defining an inner volume, at least part of the inner surface attachingly engaging an outer wall of the fluid conduit, in so doing, defining a flow path between the passage, the inner volume of the lobed vessel and an outer surface of the lobed vessel, so that in use, a fluid level is substantially maintained inside the inner volume of the lobed vessel to form a fluid seal.

There is provided that the skirt may comprise at least one lobe and at least one securing wall, the fluid conduit attachingly engaging an inner wall of the at least one securing wall.

In a preferred embodiment of the invention the skirt may comprise two lobes diametrically opposite each other and two securing walls diametrically opposite each other, which two securing walls space the two lobes from each other, the fluid conduit attachingly engaging the inner wall of the two securing walls.

There is further provided that the lobe(s) of the skirt may further comprise a step located between the closed end of the vessel and the open end of the vessel, the step defining a first region proximal the closed end and a second region proximal the open end, wherein the first region defines a smaller volume relative the second region.

The water trap may further comprise at least one mounting member extending from the first end of the fluid conduit to mount the water trap inside a housing.

The water-trap may further comprise at least one attachment means to attach the lobed vessel to the fluid conduit.

The attachment means may have a recessed face located along the conduit, the recessed face defined by the second end of the conduit and the mounting member to operatively receive and seat against the skirt of the lobed vessel in so doing attaching the lobed vessel to the fluid conduit.

The in-line water trap may further comprise an inlet/outlet chamber having at least one inlet/out means extending from and operatively attached to the mounting member, in use, the at least one inlet/outlet means conveying fluid into or out of the inlet/outlet chamber.

The housing may be selected from the group consisting of: plumbing applications, pipes, drains, fittings of pipes and fittings of drains.

There is further provided that the closed end of the vessel may be substantially dome shaped.

There is further provided that the lobed vessel may be resiliently deformable in response to pressure difference across the closed end of the lobed vessel, between an open position, wherein the closed end of the lobed vessel is spaced from the second end of the fluid conduit facilitating fluid flow between an inner volume of the lobed vessel and the passage of the fluid conduit, and a closed position, wherein the closed end of the lobed vessel abuts and seals against the second end of the fluid conduit thereby hindering fluid flow between the inner volume and the passage.

There is further provided that the second end may have extending therefrom a protrusion against which the closed end seats and seals when the water trap is in the closed position.

There is further provided that the lobed vessel may further comprise an actuation means to actuate the lobed vessel between the open and closed positions.

BRIEF DESCRIPTION OF THE DRAWING

Embodiments of the invention will be described below by way of example only and with reference to the accompanying drawings in which.

DESCRIPTION OF PREFERRED EMBODIMENTS

Figure 1A:
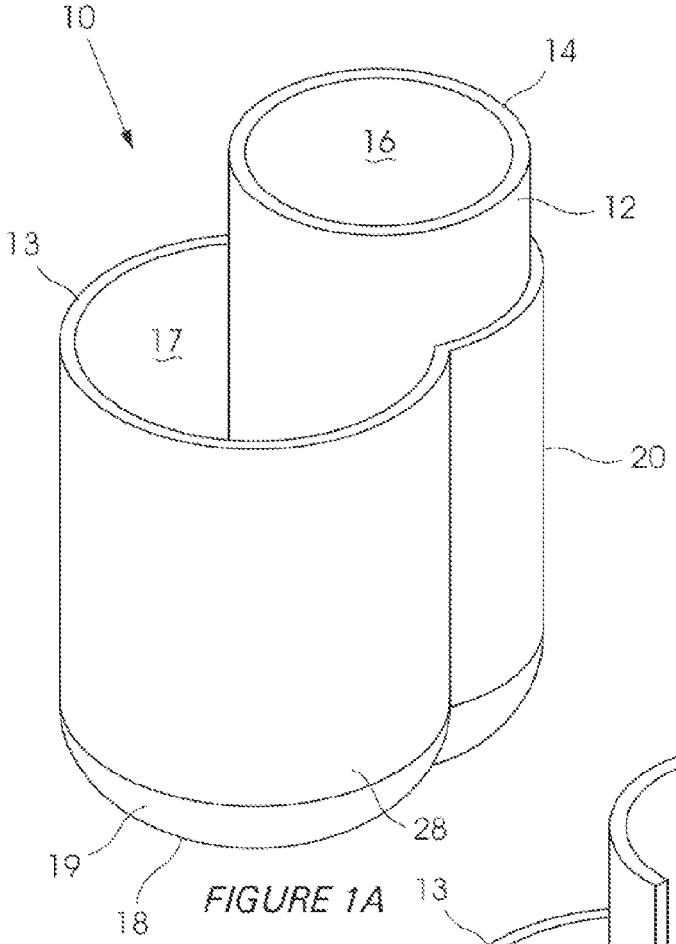
FIG. 1*a* shows a perspective view of a simple embodiment of the in-line water trap, having a single lobe, in accordance with the invention.
Figure 1B:
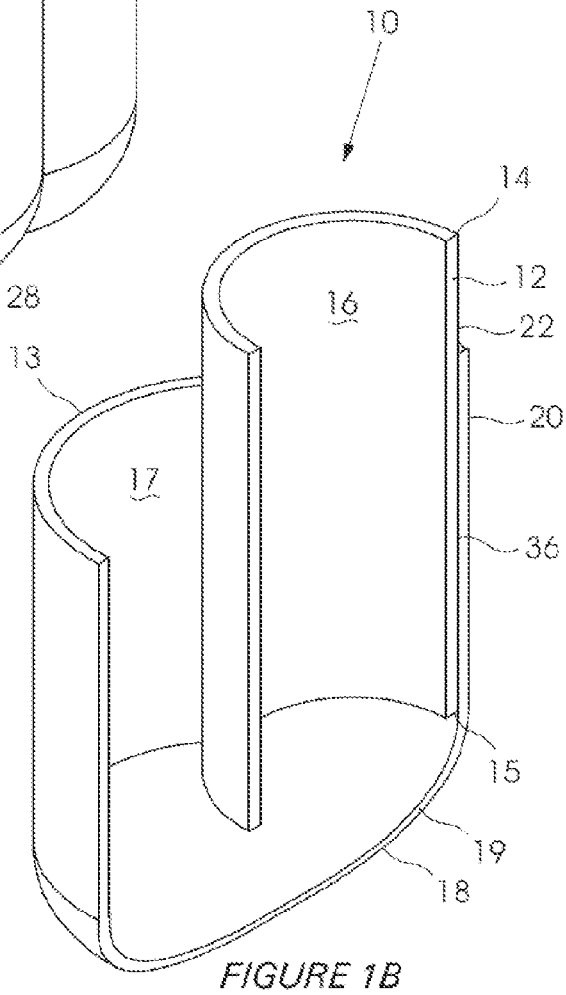
FIG. 1*b* shows a cross-sectional perspective view of the in-line water trap of FIG. 1*a*.

Referring to the accompanying diagrammatic drawings, FIGS. 1*a-b* show a simple embodiment of the invention, an in-line water trap 10, comprising a fluid conduit 12 having a first end 14 for operative engagement with a housing 30 (not shown). A typical housing 30 is shown in FIG. 2*c* where same is an outlet or pipe through which a plumbing application is drained. The water trap 10 also comprises a second end 15 and a passage 16 defining a flow path through the first end 14 and the second end 15. The in-line water trap 10 further comprises a lobed vessel 18 which is received over at least a part of the fluid conduit 12, the lobed vessel 18 having an open end and a closed end 13, 19, and a skirt 20 between the open 13 and closed 19 ends. The skirt 20 is shaped and dimensioned to define a single lobe 28 and a securing wall 36, the securing wall 36 being attached to an exterior wall 22 of the fluid conduit 12.

It is to be understood that the flow of fluid through passage 16 of the fluid conduit 12 and through an inner volume 17 of lobed vessel 18 is unrestricted meaning that a particular volume of fluid can pass between the fluid conduit 12 and the lobed vessel 18, or visa versa, with a minimal amount of restriction in its flow path.

Figure 7:
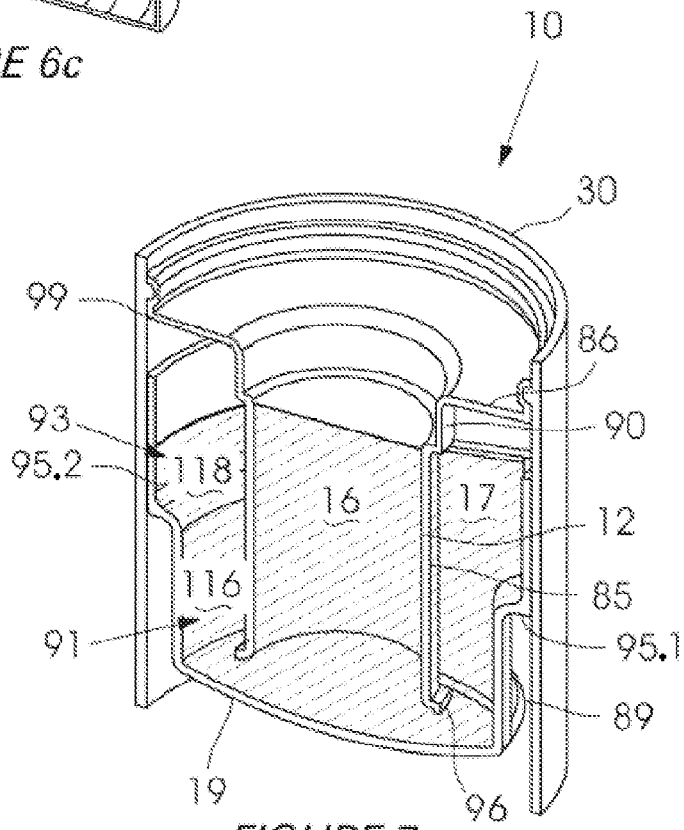
FIG. 7 shows a cross-sectional perspective view of an in-line water trap in the lobed vessel fluid-retaining position in accordance with the invention.
Figure 8:
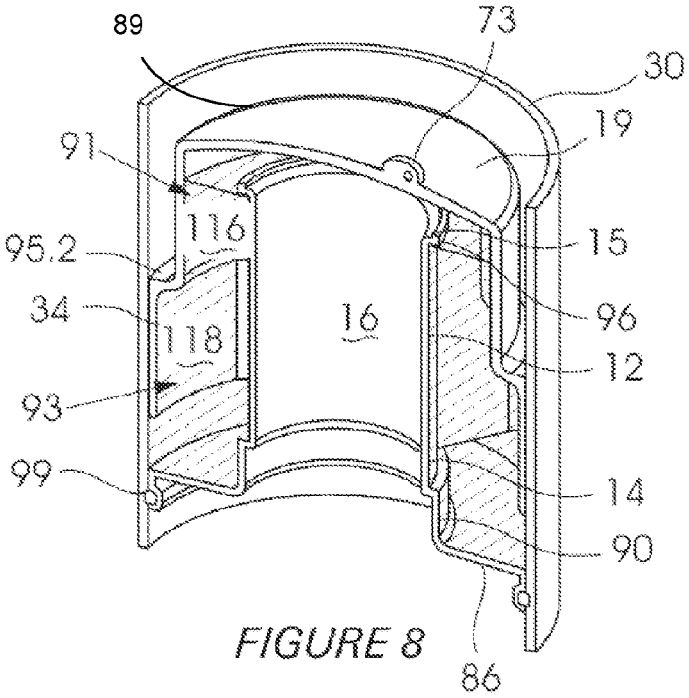
FIG. 8 shows a cross-sectional perspective view of an embodiment of the invention, an in-line water trap in the flange fluid-retaining position and in the open position.

FIG. 1*a* shows a perspective view of an embodiment of the invention wherein the lobed vessel's 18 skirt 20 is formed to define a single lobe 28 and FIG. 1*b* shows a cross-sectional view of this embodiment wherein the closed end 19 of the vessel 18 is spaced from the second end 15 of the fluid conduit 12 to provide a pathway of fluid flow between the passage 16 of the fluid conduit 12 and the lobed vessel 18. FIGS. 1*a* and *b* is a typical configuration when the water trap 10 is manufactured from a rigid material. It is however to be understood that it is not the only configuration of the invention when manufactured from a rigid material. The orientation of the water trap, either being in the lobed vessel fluid-retaining position as shown in FIG. 7 or the flange fluid-retaining position as shown in FIG. 8, inside the housing 30 will depend on the type of plumbing application that the in-line water trap 10 is to be used in and the particular functionality required of same.

Figure 2A:
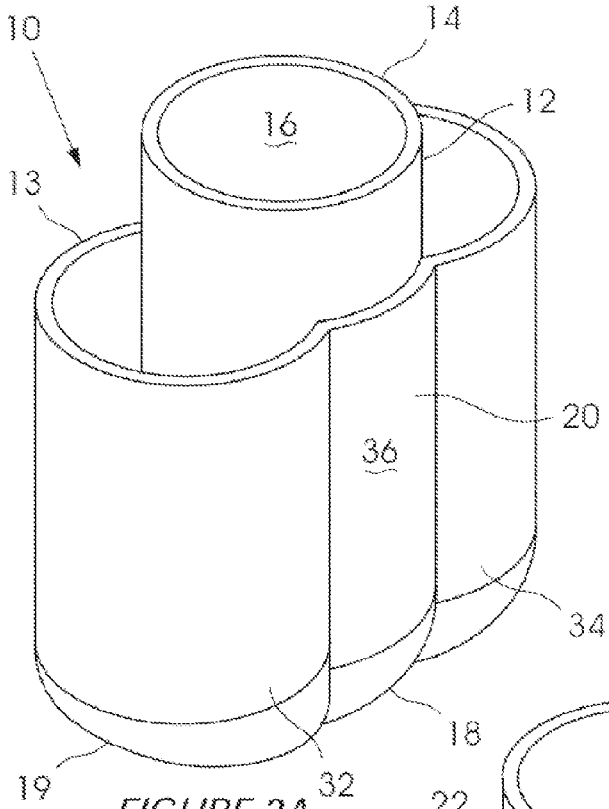
FIG. 2*a* shows a perspective view of a simple embodiment of the in-line water trap, having two lobes, in accordance with the invention.
Figure 2B:
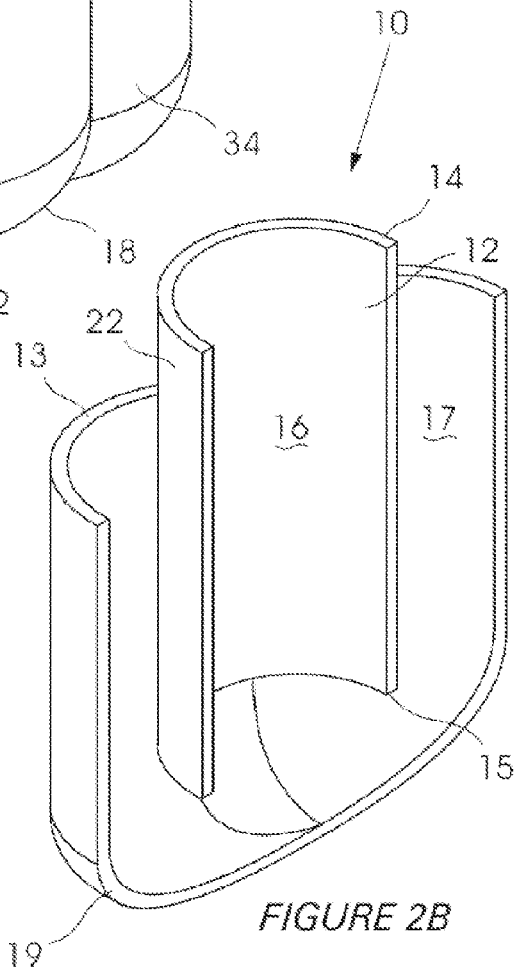
FIG. 2*b* shows a cross-sectional perspective view of the in-line water trap of FIG. 2*a*.
Figure 2C:
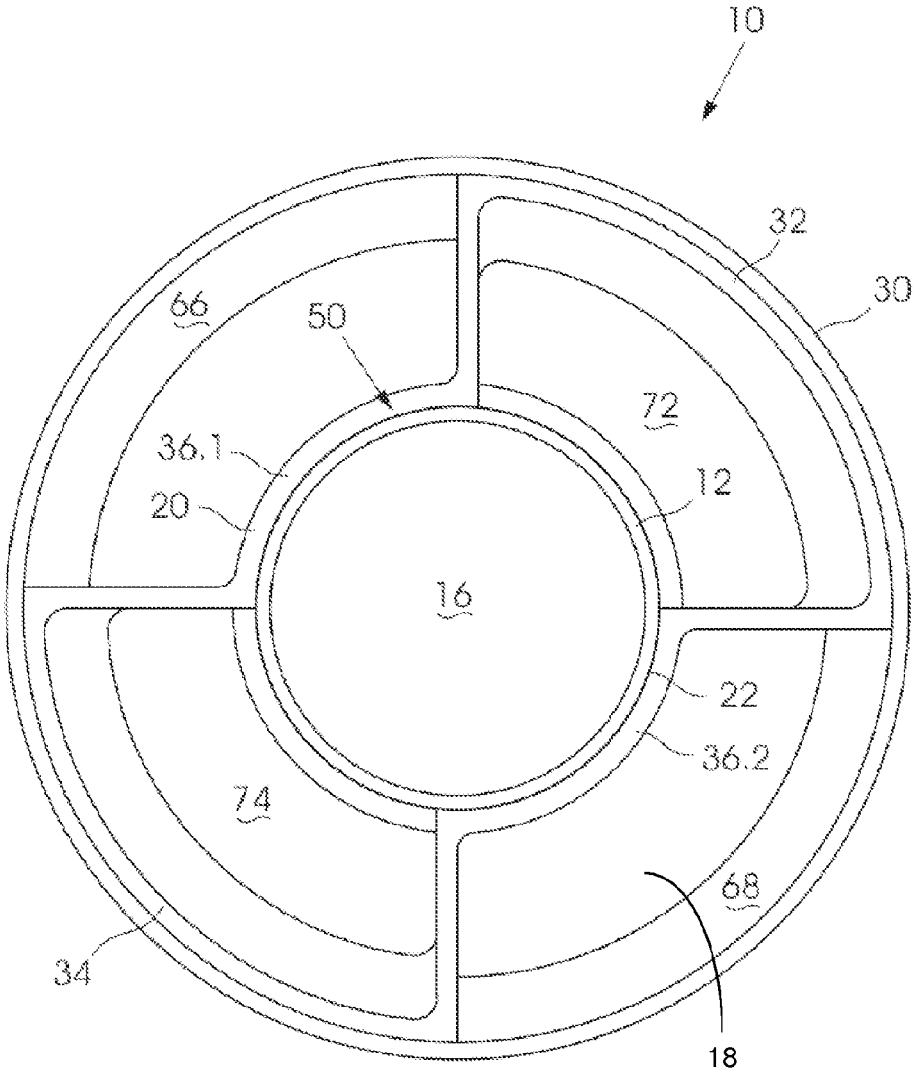
FIG. 2*c* shows a cross-sectional view of the in-line water trap with a dome shaped closed end, inside a housing in the form of a pipe in accordance with the invention.

FIGS. 2*a-c* show a second embodiment of the invention, an in-line water trap 10, wherein the lobed vessel's 18 skirt 20 is shaped and dimensioned to form two lobes 32 and 34 and two securing walls 36.1 and 36.2 (shown in FIG. 2*c*). The two lobes 32 and 34 are diametrically opposite each other and two securing walls 36.1 and 36.2 are diametrically opposite each other. The two securing walls 36.1 and 36.2 space the two lobes from each other, the fluid conduit attachingly engaging an inner wall of each of the two securing walls 36.1 and 36.2.

It is to be understood that in a preferred embodiment of the invention the lobed vessel 18 is resiliently deformable in response to pressure difference across the closed end 19 of the lobed vessel 18, between an open position (as shown in FIG.

Figure 9:
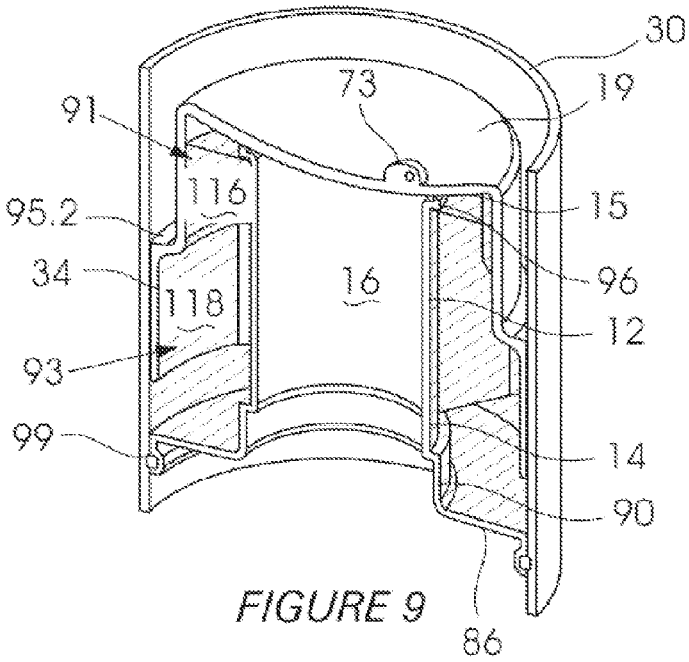
FIG. 9 shows the water trap of FIG. 8 in the closed position.

2*a-b*), wherein the closed end 19 of the lobed vessel 18 is spaced from the second end 15 of the fluid conduit 12 facilitating fluid flow between an inner volume 17 of the lobed vessel 18 and passage 16 of fluid conduit 12, and a closed position (as shown in FIG. 9), wherein the closed end 19 of the lobed vessel 18 abuts against the second end 15 of the fluid conduit 12 creating a seal so as to hinder fluid flow between the inner volume 17 and the passage 16.

FIG. 2*c* shows a cross sectional view of the in-line water trap 10 accommodated inside a housing 30 in the form of a drain pipe. In FIG. 2*c* the closed end 19 is dome shaped and assists in facilitating an effective seal when in use. The embodiments in FIGS. 1*a,b* and 1*a,b,d,e,f* do not have a dome shaped closed end 19. It is to be understood that the dome shaped closed end 19 is preferred when the water trap 10 is manufactured from a resiliently deformable material, but is not limited to being dome shaped. In FIG. 2*c* two diametrically opposing securing walls 36.1 and 36.2 of the skirt 20 of the lobed vessel 18 are attached to the exterior wall 22 of the fluid conduit 12. The two lobes 32 and 34 are formed to be optimally accommodated inside housing 30 and spaced diametrically opposite each other around the fluid conduit 12 which is located in the centre region 50. Consequently, the arrangement inside the housing 30 defines two volumes 66 and 68 between the housing 30 and the vessel 18 in addition to the two volumes 72 and 74 between the fluid conduit 12 and the vessel 18 which, when the in-line water trap 10 is in the open position, is in fluid communication with the passage 16 of the fluid conduit 12 such that there is a flow path of fluid between the passage 16 of the fluid conduit 12, the volumes 66 and 68 and the volumes 72 and 74, and said flow path has a minimal amount of restriction. Essentially, when the lobed vessel is resiliently deformable and in the flange fluid-retaining position of FIG. 8 and it is in the open position there is defined a fluid flow path between the passage 16, the volumes 72, 74, and the volumes 66, 68 such that there is flow of fluid having a minimally restricted flow path. When the in-line water trap 10 has a resiliently deformable lobed vessel 18 and it is in the deformed or closed position (as shown in FIG. 9) the closed end 19 which is dome shaped seals against the second end 15 of the fluid conduit 12, in so doing, preventing the fluid communication and flow of fluid between the passage 16 of the fluid conduit 12, the volumes 72 and 74, and volumes 66 and 68. The second end 15 may be flat ended or in an alternate embodiment may comprise at least one protrusion, preferably circular (not shown), against which the dome shaped closed end 19 may seal. It is to be understood that various sealing arrangements may be possible and that both the closed end 19 and the second end 15 may be adapted with sealing formations that will provide for effective sealing.

In a particular embodiment of the invention the closed end 19 has an actuating means in the form of a nib 73 (as shown in FIG. 9), which nib can be mechanically actuated to move the closed end 19 between the open and closed positions, when the lobed vessel 18 is resiliently deformable. The nib 73 may be centrally located on the dome but is typically off centre. The nib 73 assists a user in mechanically breaking the seal when the water trap 10 is in the closed position as shown in FIG. 9.

Figure 2D:
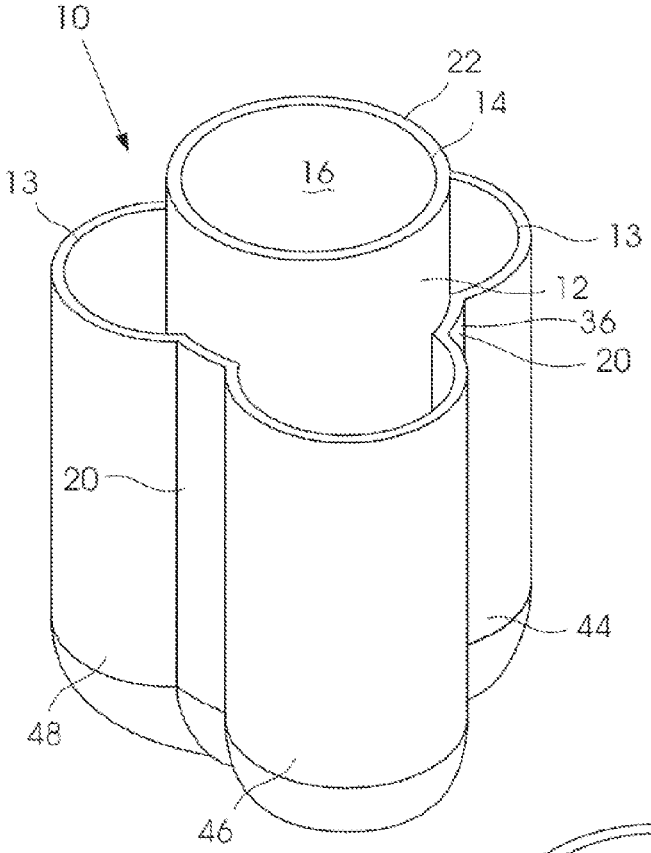
FIG. 2*d* shows a perspective view of a simple embodiment of the in-line water trap, having three lobes, in accordance with the invention.
Figure 2E:
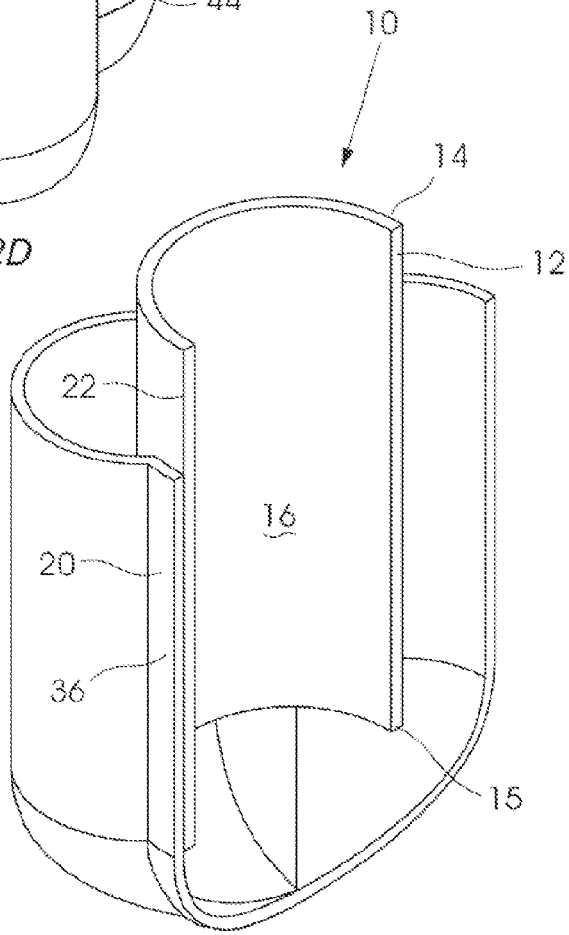
FIG. 2*e* shows a cross-sectional perspective view of the in-line water trap of FIG. 2*d*.

FIGS. 2*d-e* show an embodiment of the invention, an in-line water trap 10, wherein the lobed vessel 18 comprises three lobes 44, 46 and 48 spaced in a triangular-type arrangement. The fluid conduit 12 is located within a centre region of the triangular-type arrangement and is attached to the skirt 20 via securing walls 36 of the vessel 18 along its exterior wall 22, as described in the previous embodiments of the invention.

Figure 2F:
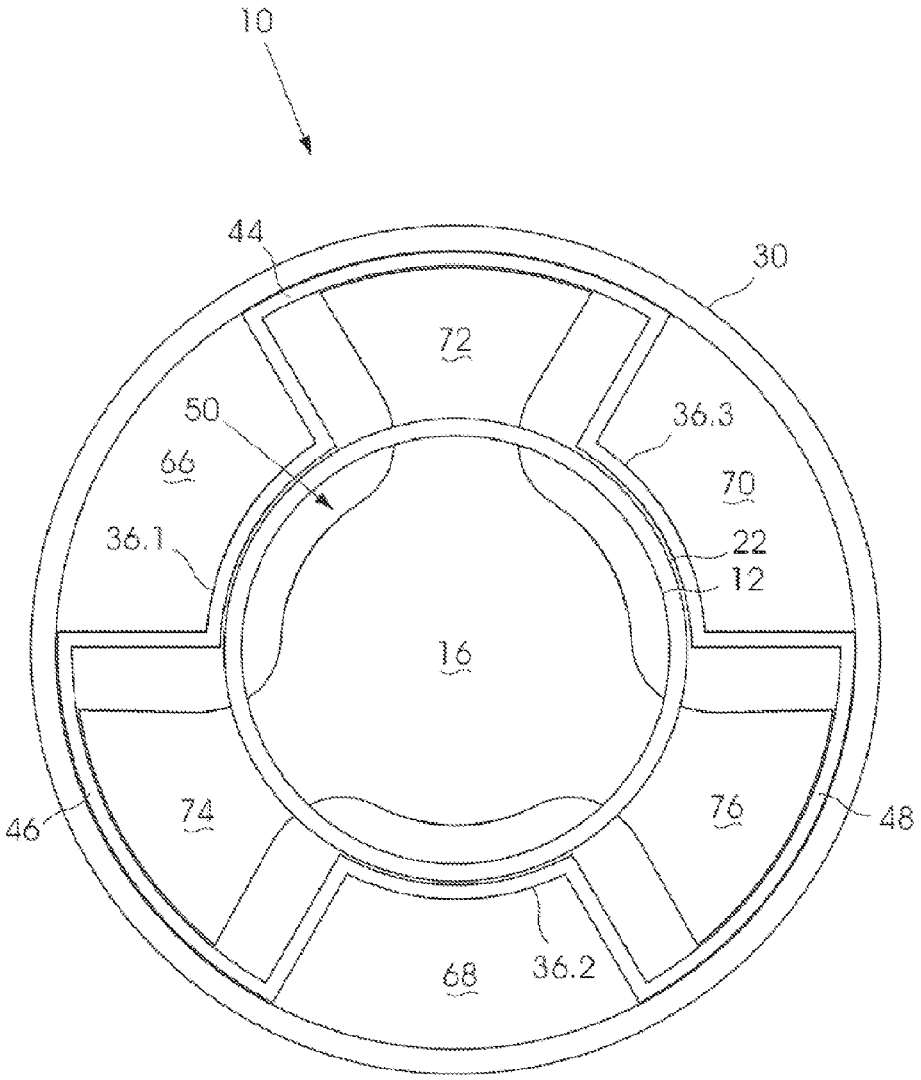
FIG. 2*f* shows a cross-sectional view of the in-line water trap of FIG. 2*d*, inside a housing in the form of a pipe in accordance with the invention.

FIG. 2*f* shows a cross sectional view of the in-line water trap 10 accommodated inside a housing 30 in the form of a drain pipe. In FIG. 2*f* three securing walls 36.1, 36.2, 36.3 of the skirt 20 of the lobed vessel 18 are attached to the exterior wall 22 of the fluid conduit 12. The three lobes 44, 46 and 48 are formed to be optimally accommodated inside the housing, in this case a pipe, and spaced in a triangular-type arrangement around the fluid conduit 12. Consequently, the arrangement inside the housing 30 defines three volumes 66, 68 and 70 between the housing 30 and the vessel 18 in addition to the three volumes 72, 74 and 76 between the fluid conduit 12 and the vessel 18. When the in-line water trap 10 is in the open position (in an embodiment where the in-line water trap 10 is resiliently deformable) the vessel 18 is in fluid communication with the passage 16 of the fluid conduit 12 such that there is a flow of fluid between the passage 16 of the fluid conduit 12, the volumes 66, 68, 70 and the volumes 72, 74 and 76, and said flow path has a minimal amount of restriction.

Figure 3:
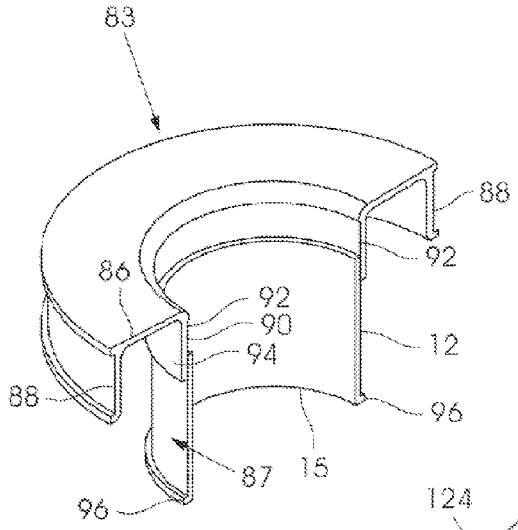
FIG. 3 shows an embodiment of a mounting member typically attached to the fluid conduit, which mounting member comprising a circular arrangement having a U-shaped cross-section.
Figure 4A:
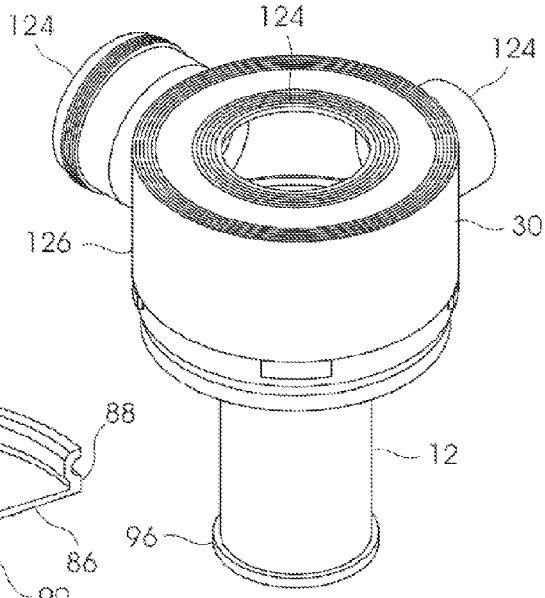
FIG. 4*a* shows an inlet/outlet chamber attached to the mounting member of FIG. 3 which mounting member is attached to a fluid conduit.
Figure 4B:
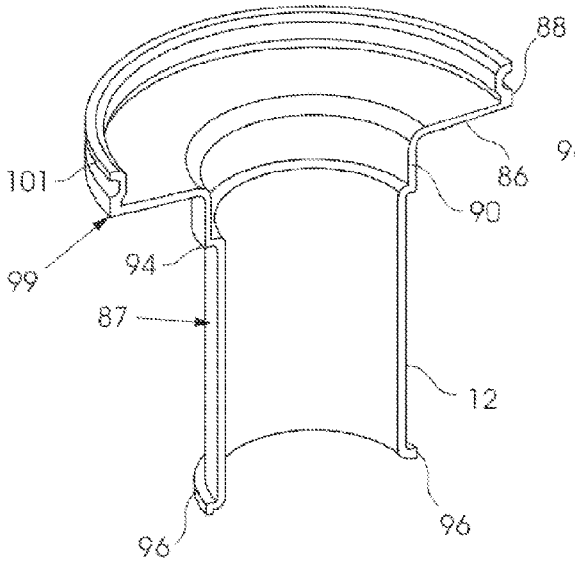
FIG. 4*b* shows an embodiment of a mounting member extending from the fluid conduit, which mounting member comprising a circular arrangement having a Z-shaped cross section.

It is important to note that the in-line water trap 10 can attach to a housing 30 via a mounting member 83, or 99, embodiments of which are shown in FIGS. 3 and 4*b*.

FIG. 3 shows an embodiment of a mounting member 83 comprising a circular arrangement having a substantially U-shaped cross section including a web 86 flanked by a pair of arms 88 and 90. In FIG. 3 the fluid conduit 12 of the in-line water trap 10 attaches to a circular recess 92 in the arm 90. In certain practical applications of the invention a grille may be mounted to the water-trap 10 via the mounting member 83 (not shown). Attachment can take place via at least a clipping, twisting or screwing means. The fluid conduit 12 further comprises a lipped protrusion 96 at its second end 15 for facilitating the securing of the resiliently deformable or rigid lobed vessel 18 which is received over the fluid conduit 12. In this embodiment the fluid conduit 12 attaches to the lobed vessel 18 via the securing walls 36 of the skirt 20 which are operatively received into an attachment means 87 in the form of a recessed portion 87 such that the outside face 85 (shown in FIG. 6*a*) of the securing wall 36 engages the recessed portion 87 defined by the lower region 94 of the arm 90 of the mounting member 83 and the lipped protrusion 96. In this particular embodiment of the invention the mounting member 83 is not manufactured as a unitary piece together with the conduit 12. It is to be understood that the mounting member 83 can be integrally formed together with the conduit 12.

FIG. 4*a* shows a housing 30 operatively engaged with the mounting means 83 in certain applications. The housing 30 comprises an inlet and/or outlet 124 means and an inlet/outlet chamber 126. It is to be understood that the housing 30 may include a number of inlet/outlet means arranged in various manners to suit various plumbing configurations. It is envisaged that the housing 30 may be moulded together with the mounting member 83 as one part, or alternatively, it may locate via a screw thread and a complementary screw thread. The inlet/outlet chamber 126 operatively attaches and extends from the mounting member 83, in use, the inlet/outlet means 124 conveys fluid into or out of the inlet/outlet chamber 126 and in turn the fluid conduit 12.

Figure 6A:
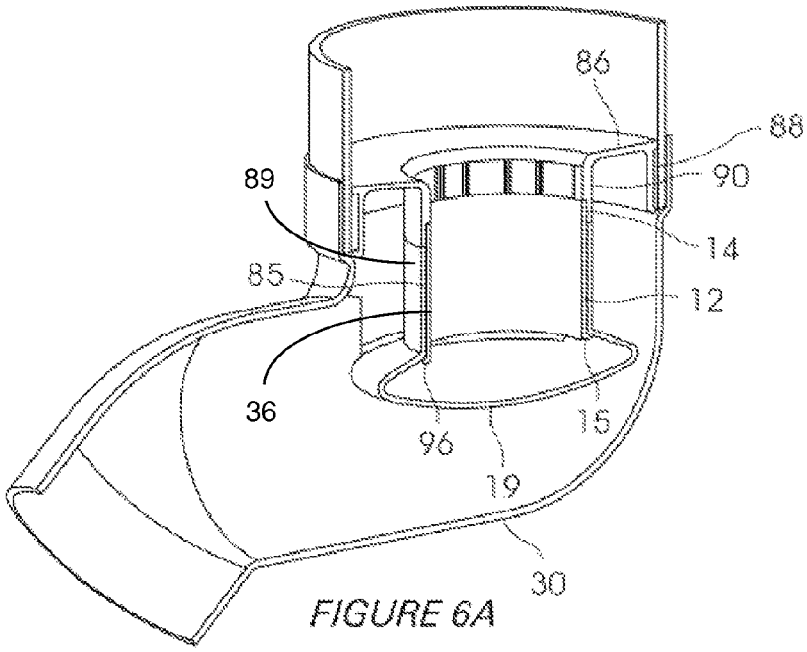
FIG. 6*a* shows a perspective view of an in-line water trap according to the invention, in use, in a plumbing application, wherein the plumbing application is a drain.
Figure 6B:
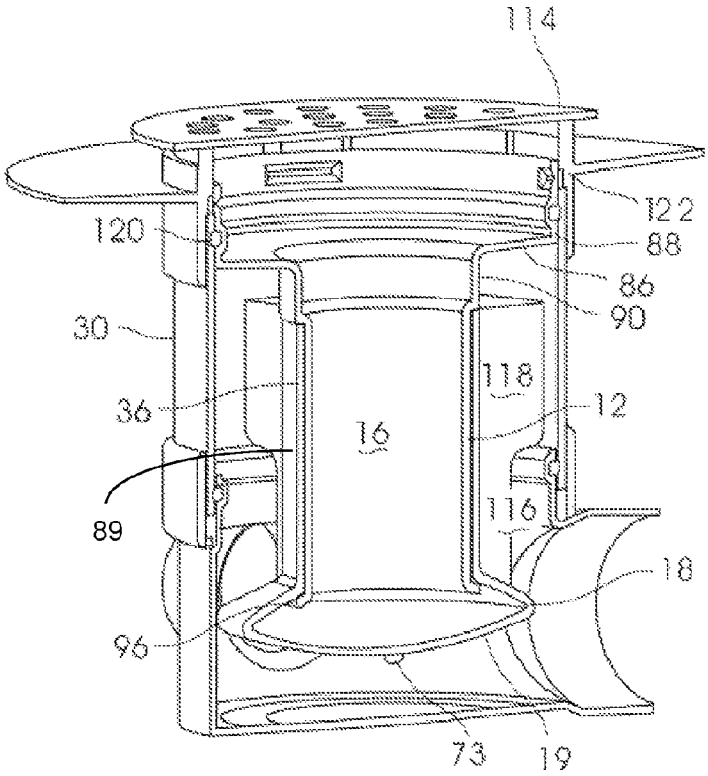
FIG. 6*b* shows a side view of an embodiment of the invention, in use, in a shower.

FIG. 4*b* shows a second embodiment of a mounting member 99 comprising a circular arrangement extending from the conduit 12 having a substantially Z-shaped cross section including a web 86 flanked by a pair of arms 88 and 90, such that the arms 88, 90 extend away from each other forming a Z-shape together with the web 86. It is to be understood that the different embodiments of the mounting members 83 and 99 have been designed as such to accommodate ease of differing manufacturing techniques, for example blow moulding and/or injection moulding. Arm 88 defines a recess 101 to operatively accommodate an O-ring 120 (shown in FIG. 6*b*) or another type of seal to facilitate forming an effective seal when mounted inside a housing 30 as shown in FIGS. 6*b* and 7. In the particular embodiment shown in FIG. 4*b* the mounting member 99 is integrally moulded to the conduit 12 such that an attachment means 87 in the form of a recessed portion 87 is defined between the lower region 94 the arm 90 and the lipped protrusion 96, which recessed portion 87 operatively accommodates outside face 85 of the securing wall 36 of the lobed vessel 18 (as shown in FIGS. 6*b* and 7).

Figure 5A:
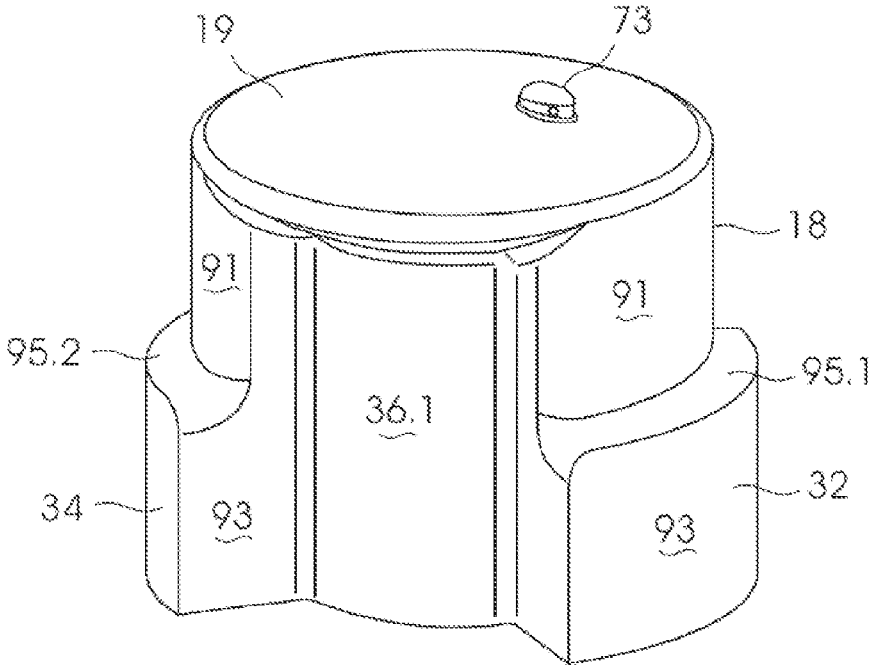
FIG. 5*a* shows an outside perspective view of an embodiment of the invention with two lobes.

FIG. 5*a* shows a side view of an embodiment of the invention wherein the two diametrically opposing lobes 32, 34 are clearly spaced by the securing wall 36.1 and 36.2 (not visible). It is evident from FIG. 5*a* that each lobe has a step 95.1, 95.2 which delimits the lobe into two regions 91 and 93, region 91 having a smaller volume relative to region 93. Each region 91 and 93 functions like a weir when in use in the lobed vessel fluid-retaining position, as shown in FIGS. 6*b* and 7. The closed end 19 defines an off centre nib 73 which can be mechanically actuated to manipulate the water trap between an open and a closed position when the water trap is resiliently deformable. Typically, the nib 73 is used by a user to mechanically break the water seal.

Figure 5B:
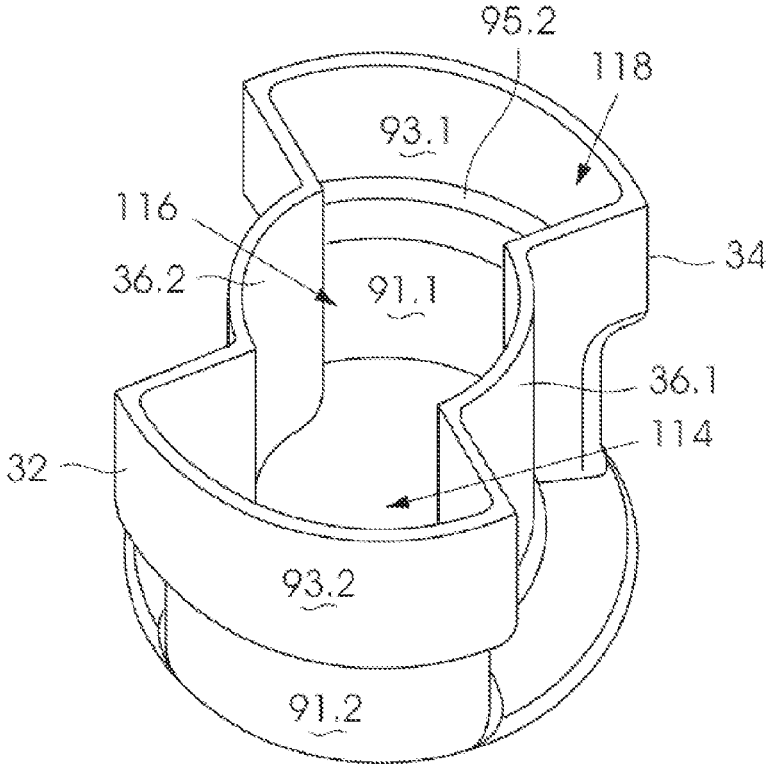
FIG. 5*b* shows an inside perspective view of an embodiment the invention with two lobes.

Regarding now to FIG. 5*b*, the lobed vessel 18 has two lobes 32 and 34. Lobe 32 comprises volume 112 (not visible but defined by region 91.2) and 114 (defined by region 93.2), where volume 114 is larger relative to volume 112. Lobe 34 comprises volume 116 (defined by region 91.1) and 118 (defined by region 93.1), where volume 118 is larger relative to volume 116. It can be seen from FIG. 5*b* that the two volumes 116 and 118 are delimited by a step 95.2. Similarly, the two volumes 112 and 114 are also delimited by a step which is not visible. The weir-like volumes 114, 118 in use in the vessel fluid-retaining position, hold residual amounts of fluid such that when disadvantageous pressure siphons the in-line water trap 10 the fluid that is siphoned from the water seal is replaced by the residual amounts of fluid contained in the volumes 114 and 118 therein functioning like weirs. The securing walls 36.1 and 36.2 of the skirt 20 are provided to attach to the exterior side wall 22 of the fluid conduit 12 (not shown). The in-line water trap 10 is secured to a housing 30 as shown in FIGS. 6*a*-*b* and 7. Typically, the housing 30 can be a pipe as shown in FIG. 7 or bend as shown in FIG. 6*a* and can be continuous with a greater reticulation system with a plurality of waste water outlets connected radially in a region of the pipe above the trap.

When the in-line water trap 10 is located in the lobed vessel fluid-retaining position as shown in FIG. 7 the lobed vessel 18 forms and retains the fluid seal. The in-line water trap 10 is positioned in such a manner that the direction of flow is substantially from the passage 16 to the inner volume 17 (comprising volumes 116 and 118 of lobe 34 as delimited by step 95.2 and volumes 112 and 114 of lobe 32 as delimited by step 95.1 [not visible]) of the lobed vessel 18, and in turn to the outer surface 89 of the lobed vessel and into the greater reticulation system. Where the in-line water trap 10 in use is in a vessel fluid-retaining position as per FIG. 7, and the lobed vessel 18 is resiliently deformable, the domed closed end 19 deforms in response to a positive pressure difference emanating from the drainage system and seals the second end 15 of the fluid conduit 12, preventing waste water and/or grey water from passing through the plumbing application.

When the in-line water trap 10 is located in the flange fluid-retaining position as shown in FIG. 8 the mounting member 99 forms and retains the water seal. The in-line water trap 10 is positioned in such a manner that the direction of flow is substantially from the outer surface 89 of the lobed vessel 18 to the inner volume (comprising volumes 116 and 118 of lobe 34 as delimited by step 95.2 and volumes 112 and 114 of lobe 32 as delimited by step 95.1 [not visible]) of the lobed vessel, and in turn to the passage 16 of the fluid conduit 12 and into the greater reticulation system. Where the in-line water trap 10 in use is in a flange fluid-retaining position as per FIG. 8, and the lobed vessel 18 is resiliently deformable, the domed closed end 19 deforms in response to a negative pressure emanating from the drainage system and seals against the second end of the fluid conduit preventing substantial loss of the water seal as is seen in FIG. 9.

When the in-line water trap 10 is in the flange fluid-retaining position shown in FIG. 8 upstream of the flow of waste a disadvantageous negative pressure may be created from time to time which will force the resiliently deformable embodiment of the lobed vessel 18 on each such occurrence to seal against the second end 15 of the fluid conduit 12, in so doing, preventing the siphoning off of the water seal and preventing the ingress of odorous gases from within the reticulation system into the plumbing application. In the event of the in-line water trap 10 siphoning dry, odorous gases will freely be able to pass from within the reticulation system into a plumbing application causing unsavory habitation conditions. The current invention strives to prevent the siphoning off of the fluid seal of the in-line water trap 10.

The resiliently deformable embodiment of the water-trap 10 alleviates the need for venting means associated with the plumbing application and/or the reticulation network.

Typically, in any embodiment of the invention, an in-line water trap 10, the lobed vessel 18 and the fluid conduit 12 are integrally moulded. It is to be understood that in alternative embodiments of the invention that the housing 30 is not limited to a drain pipe and may be any plumbing application including but not limited to the group: toilets, urinals, showers, baths, basins and gulleys. It is further to be understood that the lobed vessel 18 is in any embodiment of the invention described herein, preferably but not necessarily, resiliently deformable.

Figure 6C:
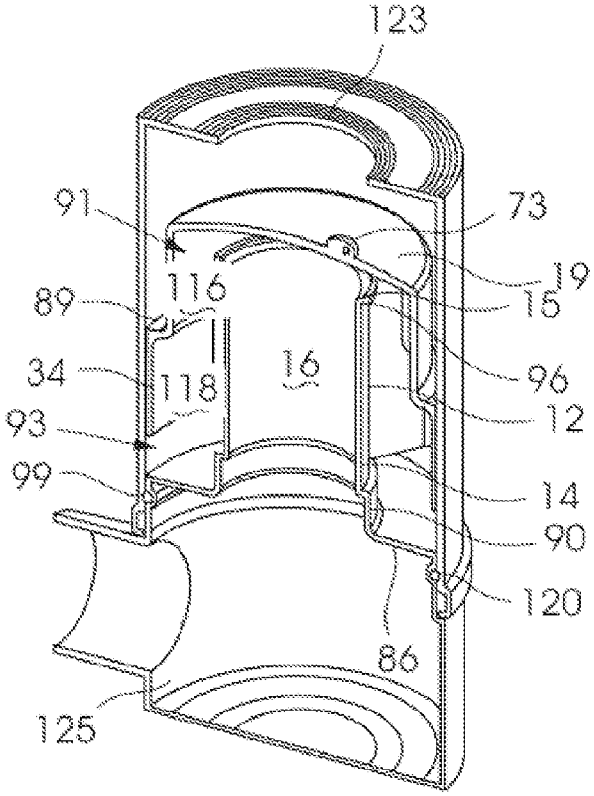
FIG. 6*c* shows a cross-sectional side view of the invention, in use, in a wash hand basin.

Generally, as shown in FIG. 6*a* the water trap can be accommodated inside a housing, typically a pipe of a plumbing application. FIG. 6*b* shows the water trap 10 installed in a waste 122 of a shower drain 114. Typically, the housing substantially accommodates the water trap. The housing can also be a drain pipe or fitting of said drain pipe, including a fitting that defines a bend. It is further to be understood that a number of plumbing applications may lead into one water trap 10, for example in one bathroom a shower, bath and basin may be in operative communication with the water trap 10. FIG. 6*c* shows the water trap 10 inside a housing in the flange fluid-retaining position (as shown in FIG. 8) wherein the housing 30 is located in a drain extending away from a handwash basin. The waste 123 of the handwash-basin will drain onto the outer surface 89 of the vessel 18, then in turn, into the inner volume 17 of the vessel, then in turn, into the passage 16 of the conduit 12 and lastly into the reticulation network 125 associated with the plumbing application.

Typically when the lobed vessel 18 is resiliently deformable it comprises a resilient plastics material to provide an effective sealing arrangement when the vessel 18 is in the closed position preventing fluid flow through several parts of the in-line water trap 10 which would otherwise be in fluid communication with one another. When the lobed vessel 18 is rigid it typically comprises, but is not limited to, a rigid plastics material.

It is to be understood that the housing 30 may comprise, but is not limited to, at least one of the following group of substances: polymer, ceramic, metal, clay, cast iron and cement.

It must be further understood that the housing 30 is not limited to being a pipe and extends to various plumbing applications. Similarly, the conduit 12 and the mounting member 83, 99 may comprise, but is not limited to, at least one of the following group of substances: polymer, ceramic, metal, clay, cast iron and cement.

The above described embodiments of the invention provide a more effective means to prevent the ingress of odours and/or sewerage and/or grey water into a plumbing application from within a greater reticulation system whilst concomitantly providing for an effective means to hinder the siphoning off of a water trap. It further provides a more effective means of allowing waste and or grey water from passing through a plumbing application in so doing self flushing and reducing the possibility of waste material being retained in the trap and causing blockages. Furthermore, the water-trap in accordance with the invention allows access to the trap for maintenance via an outlet of a plumbing application and does not require separate access via for example an access panel. The water-trap in accordance with the invention when resiliently deformable also alleviates the need for venting means.

While the invention has been described in detail with respect to specific embodiments thereof, it will be appreciated that those skilled in the art, upon attaining an understand of the foregoing may readily conceive of alterations to, variations of and equivalents to these embodiments. Accordingly, the scope of the present invention should be assessed as that of the appended claims and any equivalents thereto.

The invention claimed is:

1. An in-line water trap comprising:

a fluid conduit having a first end, a second end and a passage between the first and second ends; and a resiliently deformable lobed vessel for receiving the conduit having a closed end, an open end and a skirt between the closed and open ends, an inner surface of the closed end, open end and skirt defining an inner volume, at least part of the inner surface attachingly engaging an outer wall of the fluid conduit in so doing defining a flow path between the passage, the inner volume of the lobed vessel and an outer surface of the lobed vessel, so that in use, a fluid level is substantially maintained inside the inner volume of the lobed vessel to form a fluid seal, wherein the lobed vessel is resiliently deformable in response to pressure difference across the closed end of the lobed vessel, between an open position, wherein the closed end of the lobed vessel is spaced from the second end of the fluid conduit facilitating fluid flow between an inner volume of the lobed vessel and the passage of the fluid conduit, and a closed position, wherein the closed end of the lobed vessel abuts and seals against the second end of the fluid conduit thereby hindering fluid flow between the inner volume and the passage.

2. The in-line water trap according to claim 1, wherein the skirt is shaped and dimensioned to comprises two lobes diametrically opposite each other and two securing walls diametrically opposite each other, which two securing walls space the two lobes from each other, the fluid conduit attachingly engaging the inner wall of the two securing walls.

3. The in-line water trap according to claim 1, wherein the lobe(s) of the skirt further comprises a step located between the closed end of the vessel and the open end of the vessel, the step defining a first region proximal the closed end and a second region proximal the open end, wherein the first region defines a smaller volume relative the second region.

4. The in-line water trap according to claim 3, further comprising at least one mounting member extending from the first end of the fluid conduit to mount the water trap inside a housing.

5. The in-line water trap according to claim 4, further comprising at least one attachment means to attach the lobed vessel to the fluid conduit.

6. The in-line water trap according to claim 5, wherein the attachment means comprises a recessed face located along the conduit, the recessed face defined by the second end of the conduit and the mounting member to operatively receive and seat against the skirt of the lobed vessel in so doing attaching the lobed vessel to the fluid conduit.

7. The in-line water trap according to claim 6, further comprising an inlet/outlet chamber having at least one inlet/out means extending from and operatively attached to the mounting member, in use, the at least one inlet/outlet means conveying fluid into or out of the inlet/outlet chamber.

8. The in-line water trap according to claim 1, wherein the closed end of the vessel is substantially dome shaped.

9. The in-line water trap according to claim 8, wherein the second end has extending therefrom a protrusion against which the closed end seats and seals when the water trap is in the closed position.

10. The in-line water trap according to claim 8, wherein the closed end of the lobed vessel further comprises an actuation means to actuate the lobed vessel between the open and closed positions.

* * * * *